US010406549B2

(12) United States Patent
Logan

(10) Patent No.: US 10,406,549 B2
(45) Date of Patent: Sep. 10, 2019

(54) SYSTEM FOR TREATING A SURFACE

(71) Applicant: FORJAK Industrial, Inc., Columbus, OH (US)

(72) Inventor: Adam Garvey Logan, Pickerington, OH (US)

(73) Assignee: FORJAK Industrial, Inc., Columbus, OH (US)

( * ) Notice: Subject to any disclaimer, the term of this patent is extended or adjusted under 35 U.S.C. 154(b) by 71 days.

(21) Appl. No.: 15/248,046

(22) Filed: Aug. 26, 2016

(65) Prior Publication Data

US 2017/0056908 A1 Mar. 2, 2017

Related U.S. Application Data

(60) Provisional application No. 62/210,702, filed on Aug. 27, 2015.

(51) Int. Cl.

| | |
|---|---|
| ***B05B 13/00*** | (2006.01) |
| ***B05B 9/00*** | (2006.01) |
| ***B05B 12/00*** | (2018.01) |
| ***B05B 13/04*** | (2006.01) |
| ***B05B 15/628*** | (2018.01) |
| ***B05B 15/68*** | (2018.01) |
| *B05B 9/04* | (2006.01) |

(52) U.S. Cl.

CPC ..... *B05B 13/005* (2013.01); *B05B 9/007* (2013.01); *B05B 12/002* (2013.01); *B05B 13/04* (2013.01); *B05B 15/628* (2018.02); *B05B 15/68* (2018.02); *B05B 9/0423* (2013.01)

(58) Field of Classification Search

CPC . B05B 9/007; B05B 13/0405; B05B 13/0468; B05B 13/041; B05B 13/005; B05B 15/628; B05B 15/68; B05B 12/002; B05B 13/04; B05B 12/00; B05B 9/01; B05B 15/656; A01M 7/0053; A01M 7/005; A01M 7/0075; A01M 7/006; A01M 7/0082

USPC ..... 239/67, 69, 71, 73, 159–165, 172, 176, 239/280.5, 181, 525, 536, 578; 118/305, 118/315, 323

See application file for complete search history.

(56) References Cited

U.S. PATENT DOCUMENTS

| | | | | |
|---|---|---|---|---|
| 1,440,147 | A | | 12/1922 | Heinrich |
| 2,365,755 | A | | 12/1944 | Griffith |
| 2,574,206 | A | | 11/1951 | Browning |
| 2,829,896 | A | | 4/1958 | Swenson |
| 3,219,276 | A | | 11/1965 | Norris |
| 3,274,860 | A | | 9/1966 | Gauthier et al. |
| 3,592,387 | A | * | 7/1971 | Pilott ..... B05B 13/041 239/752 |
| 3,786,965 | A | | 1/1974 | James et al. |
| 3,863,393 | A | | 2/1975 | Goff |
| 3,957,203 | A | | 5/1976 | Bullard |
| 4,199,905 | A | | 4/1980 | Neidigh et al. |
| 4,222,522 | A | | 9/1980 | Kubo et al. |
| 4,239,431 | A | | 12/1980 | Davini |

(Continued)

FOREIGN PATENT DOCUMENTS

GB 2450166 A 12/2008

*Primary Examiner* — Steven J Ganey

(74) *Attorney, Agent, or Firm* — Ulmer & Berne LLP

(57) ABSTRACT

A system for treating a surface of a structure includes a wheeled vehicle that is movable along a surface and includes at least one spray head attached to a vertically movable carriage.

14 Claims, 6 Drawing Sheets

(56) References Cited

U.S. PATENT DOCUMENTS

| | | | | |
|---|---|---|---|---|
| 4,327,666 | A | | 5/1982 | Lee |
| 4,417,542 | A | | 11/1983 | Bellafiore |
| 4,501,223 | A | | 2/1985 | Matsuno et al. |
| 4,545,156 | A | | 10/1985 | Hockett |
| 4,690,328 | A | | 9/1987 | Roehl |
| 4,779,798 | A | | 10/1988 | Natolino et al. |
| 4,785,760 | A | | 11/1988 | Tholome |
| 4,801,096 | A | | 1/1989 | Kumagai |
| 4,835,811 | A | | 6/1989 | Crowhurst |
| 4,878,598 | A | | 11/1989 | Ruschhaupt, Jr. |
| 4,944,243 | A | | 7/1990 | Takeno et al. |
| 5,346,140 | A | * | 9/1994 | Campbell ..... B05B 13/0415 239/750 |
| 5,358,568 | A | | 10/1994 | Okano et al. |
| 5,671,889 | A | | 9/1997 | Petty |
| 5,851,580 | A | | 12/1998 | Amberg et al. |
| 5,897,061 | A | | 4/1999 | Petty |
| 5,927,609 | A | | 7/1999 | Scarpa et al. |
| 5,935,657 | A | | 8/1999 | Melendez |
| 5,968,271 | A | | 10/1999 | Maxwell et al. |
| 6,116,318 | A | | 9/2000 | Mauney |
| 6,589,343 | B1 | | 7/2003 | Egeland |
| 7,080,888 | B2 | | 7/2006 | Hach |
| 8,726,833 | B2 | | 5/2014 | Logan et al. |
| 9,393,594 | B2 | | 7/2016 | Logan et al. |
| 2008/0226379 | A1 | | 9/2008 | Kott et al. |
| 2013/0236644 | A1 | | 9/2013 | Logan et al. |
| 2016/0199858 | A1 | | 7/2016 | Logan et al. |

* cited by examiner

SYSTEM FOR TREATING A SURFACE

REFERENCE TO RELATED APPLICATIONS

This application claims priority to U.S. Provisional Patent Application Ser. No. 62/210,702, filed Aug. 27, 2015, the contents of which is incorporated herein by reference in its entirety.

TECHNICAL FIELD

This application relates generally to treating a surface, and more particularly to a system for coating a surface of a structure.

BACKGROUND

Certain structures, such as interior walls, exterior walls, and/or ceilings of buildings, require periodic maintenance that includes painting. Known methods of painting such structures include manually preparing the structure for the application of paint using brushes and/or water spray nozzles, and then manually painting the structure, which is labor intensive.

SUMMARY

In accordance with one embodiment, a system for treating a surface is provided. The system comprises a wheeled cart, a lift structure, and a pump. The wheeled cart comprises a frame and a plurality of wheels rotatably coupled with the frame. The lift structure is coupled with the frame and comprises a mast, a carriage, a plurality of first spray heads, and a plurality of second spray heads. The carriage is slidably coupled with the mast and is movable between a raised position and a lowered position. The plurality of first spray heads are coupled with the carriage and are disposed on a right side of the wheeled cart. The plurality of second spray heads are coupled with the carriage and are disposed on a left side of the wheeled cart. The pump is in fluid communication with the plurality of first spray heads and the plurality of second spray heads and is configured to distribute a fluid to the plurality of first spray heads and the plurality of second spray heads.

In accordance with another embodiment, a system for treating a surface is provided. The system comprises a wheeled cart, a lift structure, and a supply unit. The wheeled cart comprises a frame and a plurality of wheels rotatably coupled with the frame. The lift structure is coupled with the frame and comprises a mast, a carriage, and a surface treatment device. The carriage is slidably coupled with the mast and is movable between a raised position and a lowered position. The surface treatment device is coupled with the carriage and is disposed on one or more of a right side and a left side of the wheeled cart. The supply unit is in communication with the surface treatment device and is configured to supply material to the surface treatment device.

In accordance with yet another embodiment, a system for treating a surface is provided. The system comprises a carriage, a plurality of spray heads, a pump, and a plurality of triggering mechanisms. The plurality of spray heads are coupled with the carriage. The pump is in fluid communication with the plurality of spray heads and is configured to distribute a fluid to the plurality of spray heads. The plurality of triggering mechanisms are each associated with one of the spray heads and configured to facilitate dispensation of paint therefrom. Each of the triggering mechanisms is operably coupled together to facilitate substantially simultaneous dispensation of paint from the spray heads.

BRIEF DESCRIPTION OF THE DRAWINGS

Various embodiments of a system and method for painting a structure will become better understood with regard to the following description, appended claims and accompanying drawings wherein:

DETAILED DESCRIPTION

Figure 1:
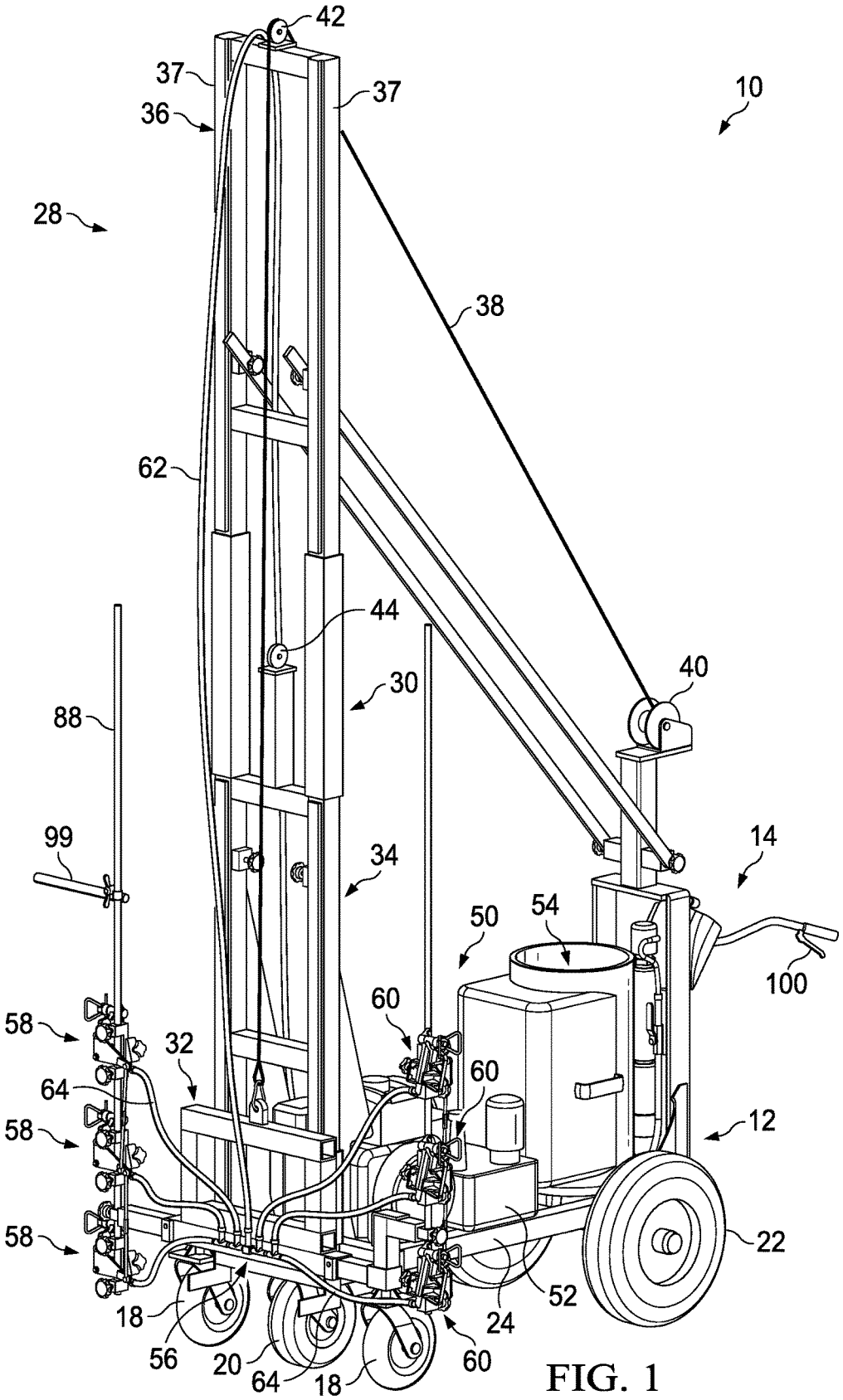
FIG. 1 is a perspective view depicting a system for painting a structure according to one embodiment, the system having a wheeled cart having a carriage.
Figure 2:
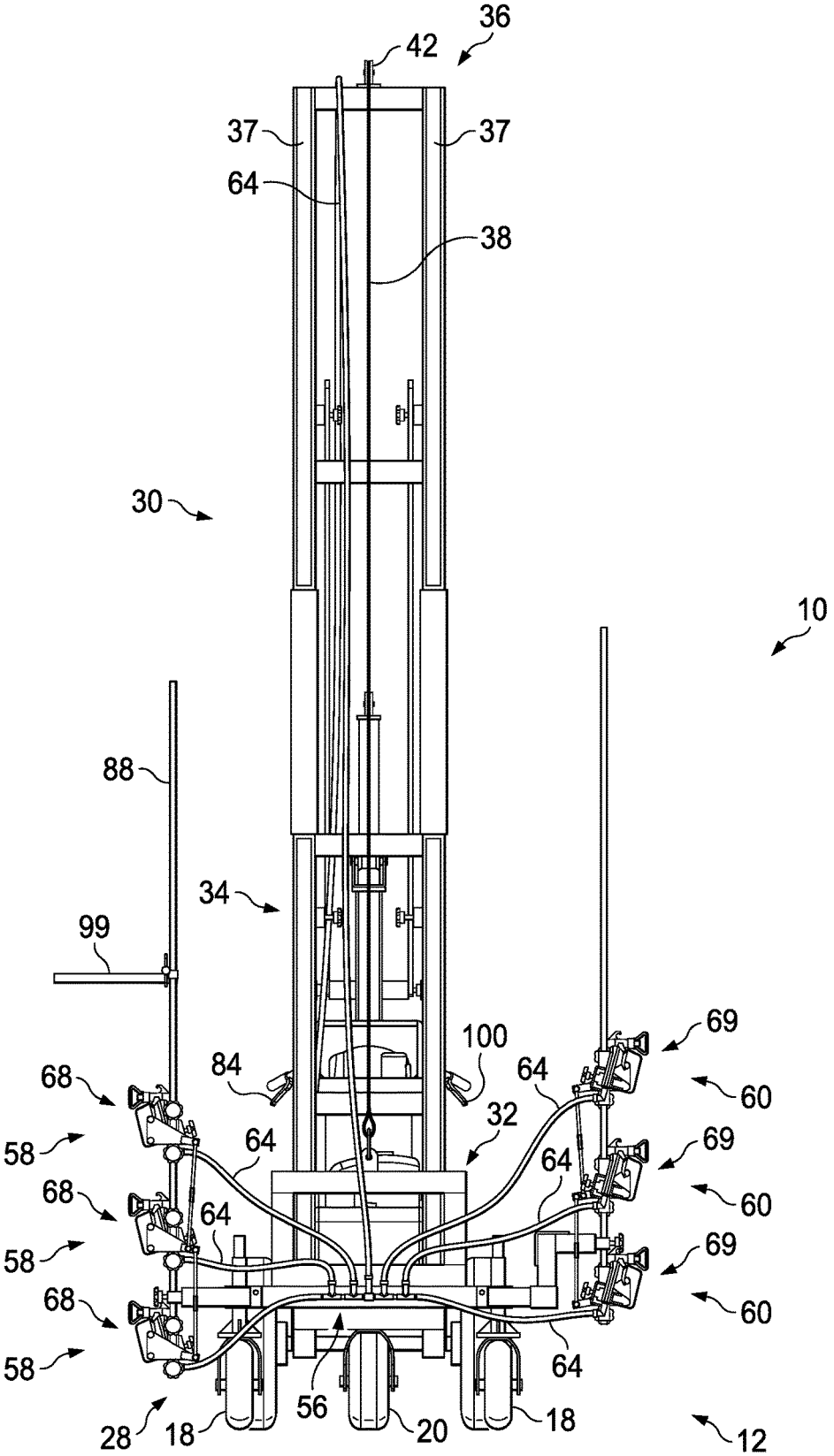
FIG. 2 is a front view depicting the wheeled cart of FIG. 1, wherein the carriage is shown in a lowered position.
Figure 3:
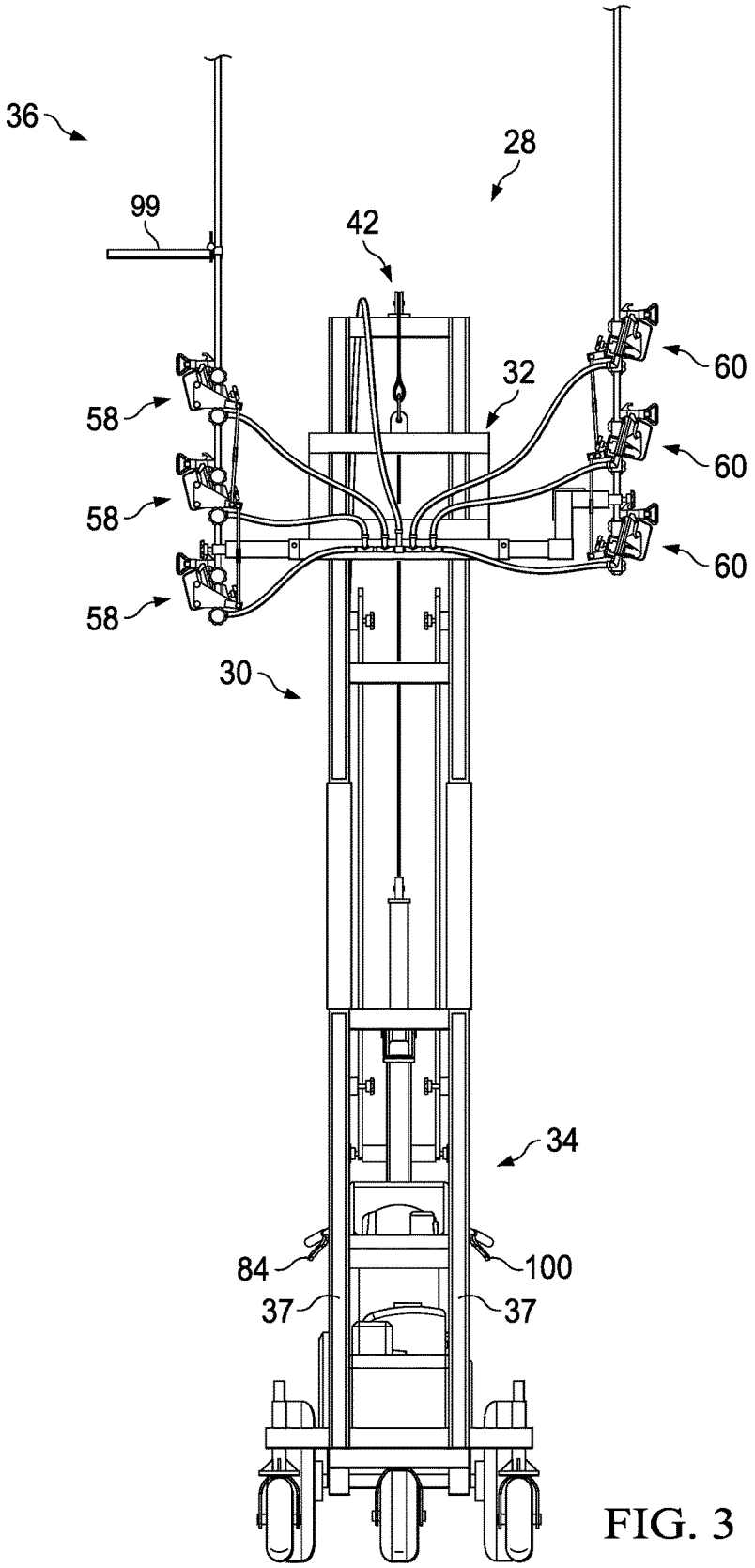
FIG. 3 is a front view depicting the wheeled cart of FIG. 2, but with the carriage in a raised position.

Referring to the drawings, wherein like reference numbers indicate the same or corresponding elements throughout the views, FIGS. 1-4 illustrate a system 10, according to one embodiment, for painting a structure. As illustrated in FIGS. 1-3, the system 10 can include a wheeled cart 12 having handlebars 14 that can be grasped by a user. The wheeled cart 12 can be a push-type cart that is moved by a user pushing/pulling the handlebars 14 and/or can be a self-powered cart that is moved by actuating a lever or other device on the wheeled cart 12. The wheeled cart 12 can include a pair of outer front wheels 18, a center front wheel 20, and a pair of rear wheels 22. The wheels 18, 20, 22 can be rotatably coupled with a frame 24, such that the wheeled cart 12 can move, or roll, along a surface. The outer front wheels 18 and the center front wheel 20 can be pivotable to allow for steering of the wheeled cart 12. The center front wheel 20 can be selectively locked in a straight forward position through actuation of lever (not shown), to facilitate straight forward movement of the wheeled cart 12. The wheeled cart 12 can also include a drivetrain (not shown) for transferring torque from a source of motive power to at least one of the front wheels 18, 20 and the rear wheels 22, such that the wheeled cart 12 can be driven by an operator. In one embodiment, the wheeled cart 12 can include a leveling mechanism (not shown) that can facilitate leveling of the wheeled cart 12 prior to use. In some embodiments, this leveling mechanism can include wheeled outriggers that can be adjusted to level the wheeled cart 12 while still permitting movement of the wheeled cart 12.

Still referring to FIGS. 1-3, the wheeled cart 12 can also include a lift structure 28 that can be coupled with the frame 24. The lift structure 28 can include a mast 30 and a carriage 32 that is vertically slidable on the mast 30. The mast 30 can have a lower portion 34 and an upper portion 36 that is releasably coupled with the lower portion 34. The upper portion 36 can be selectively removed to accommodate for use of the wheeled cart 12 in low clearance areas and/or to aid in effective transporting of the wheeled cart 12 (e.g., in a trailer). A pair of support rails 37 can be coupled to the frame 24 and the upper portion 36 of the mast 30 to provide support to the upper portion 36 of the mast 30. When the upper portion 36 is removed, the support rails 37 can be pivoted into a lower position and attached to the lower portion 34 to provide support for the lower portion 34.

A cable 38 can be attached at one end to the carriage 32 and at the other end to a winch 40. The winch 40 can be operated (e.g., manually or with a motor) to facilitate positioning of the carriage 32 along the mast 30 between a lower position (FIGS. 1 and 2) and an upper position (FIG. 3). The cable 38 can be routed over either an upper pulley 42 (FIG. 3) or a lower pulley 44 (FIG. 1) depending upon whether the upper portion 36 of the mast 30 is attached. It is to be appreciated that the carriage 32 can be alternatively raised and lowered by a system that can include one or more hydraulic cylinders and one or more chains, in a manner known in the art. In other embodiments, movable carriages can be provided that can be raised and lowered in a manner other than that shown. It is also to be appreciated that the height of the mast 30 can be selected to allow the carriage 32 to be raised to any desirable elevation.

The wheeled cart 12 can include a sprayer assembly 50 that facilitates the spraying of paint, or other fluid, from the wheeled cart 12. The sprayer assembly 50 can include a pump 52, a reservoir 54, a manifold 56, a plurality of right spray heads 58, and a plurality of left spray heads 60. The pump 52 can be in fluid communication with the manifold 56 via a main feed line 62. Each of the left and right spray heads 58, 60 can be in fluid communication with the manifold 56 via respective distribution lines (e.g., 64). When the pump 52 operates, paint can be pumped from the reservoir 54 to the manifold 56 via the main feed line 62 and distributed to the right and left spray heads 58, 60 via the distribution lines (e.g., 64). It is to be appreciated that paint can be delivered from the reservoir 54 to the manifold 56 via any of a variety of suitable additional or alternative methods.

Figure 4:
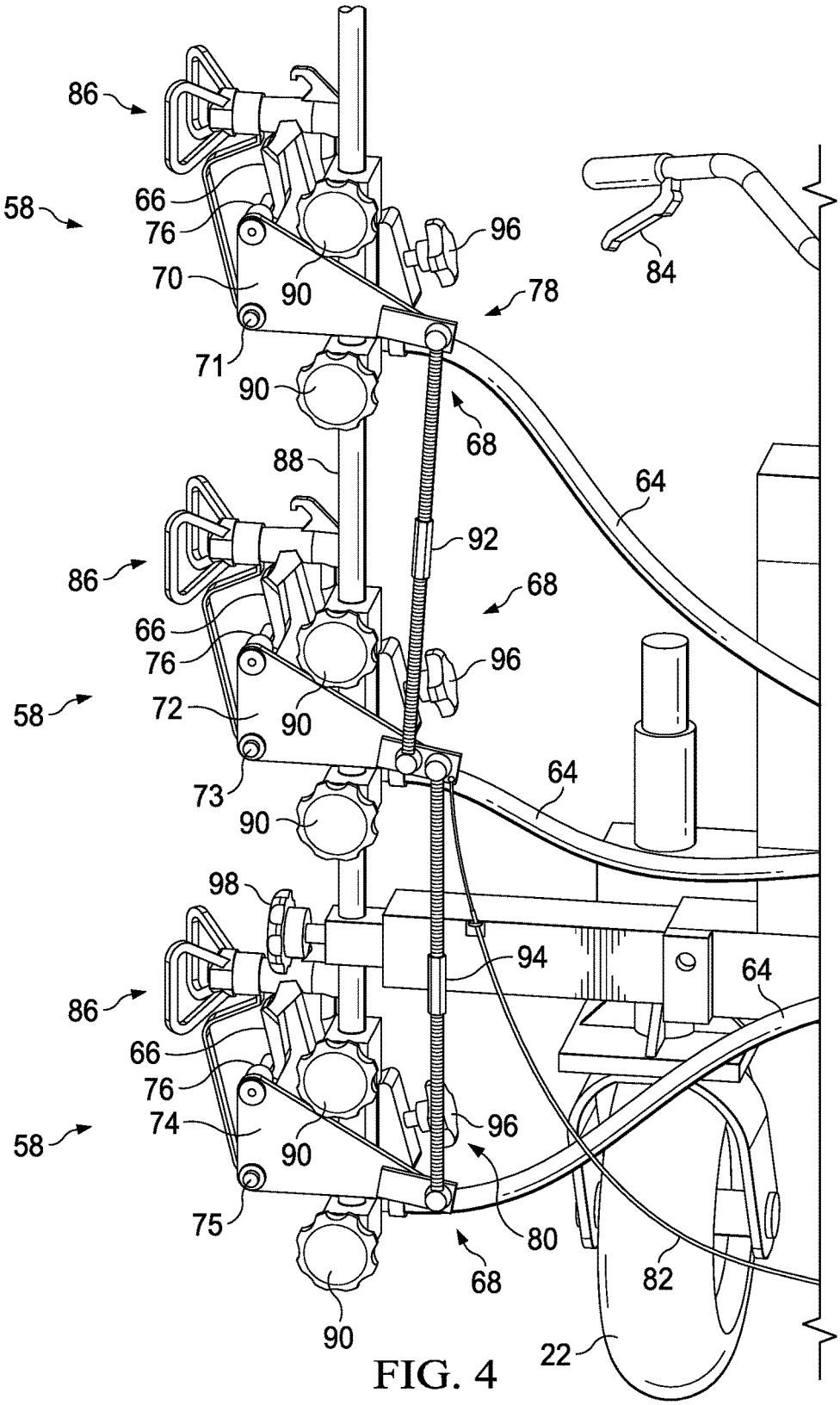
FIG. 4 is an enlarged view depicting right spray heads of the carriage of FIG. 1 in association with various other components of the wheeled vehicle.

Referring now to FIG. 4, operation of the right spray heads 58 will now be discussed. Each of the right spray heads 58 can include a trigger 66, which, when actuated, causes paint to spray from the right spray heads 58. A triggering mechanism 68 can be associated with each of the triggers 66 to facilitate selective depression of the triggers 66. The triggering mechanism 68 can include upper, central and lower trigger plates 70, 72, 74 that are each associated with one of the triggers 66. Each of the trigger plates 70, 72, 74 can include a post 76 that engages the respective trigger 66 of each right spray head 58. The trigger plates 70, 72, 74 can be pivotable about respective pins 71, 73, 75. An upper tie rod 78 can be pivotally coupled to the upper and central trigger plates 70, 72 and a lower tie rod 80 can be pivotally coupled to the central and lower trigger plates 72, 74. A cable 82 can be coupled to the central trigger plate 72 and operably connected to a left lever 100 on the handlebars 14 (FIG. 1). When the left lever 100 is actuated, the cable 82 can pull the central trigger plate 72 downwardly such that it pivots in a clockwise direction. This pivoting of the central trigger plate 72 can cause the upper and lower trigger plates 70, 74 to correspondingly pivot (e.g., via upper and lower tie rods 78, 80). Pivoting of the trigger plates 70, 72, 74 in this manner can actuate the triggers 66 of the right spray heads 58 substantially simultaneously to dispense paint therefrom. In one embodiment, the cable 82 can be a Bowden-type cable. It is to be appreciated that any of a variety of alternative actuator arrangements can be provided to facilitate substantially simultaneous dispensation of paint from multiple spray heads. For example, each of the spray heads can be electronically actuated, such as with a servo, that is controlled in response to actuation of a pushbutton. The operation of these electronic actuators can be automated by an electronic control unit or other suitable control interface.

In one embodiment, right spray heads 58 can be a Low Overspray Cleanshot™ Valve made by Graco Inc. The right spray heads 58 can have respective tips 86 and/or nozzles (not shown) that can be selected to provide a desired spray pattern. In one embodiment, the carriage 32 can be fitted with paint shields (not shown) that are associated with the right and left spray heads 58, 60 and configured to inhibit overspray along the painted surface as well as the surface beneath the carriage 32 (e.g., the ground).

The vertical positions of the right spray heads 58 can be adjusted relative to one another to achieve a desired vertical spacing between adjacent right spray heads 58 to achieve a desired overlap of the spray patterns of each adjacent pair of the right spray heads 58. In one embodiment, each of the right spray heads 58 can be slidably coupled to a right support post 88 and can include a pair of rotatable knobs 90 that can selectively lock the vertical position of the right spray heads 58 with respect to the right support post 88. When one of the right spray heads 58 is locked, both of the rotatable knobs 90 can be rotated in one direction (e.g., counterclockwise) to release the right spray head 58 such that it is free to slide along the right support post 88. Once a position of the right spray head 58 has been selected, both of the rotatable knobs 90 can be rotated in the other direction (e.g., clockwise) to lock the right spray head 58 in place.

Still referring to FIG. 4, the upper and lower tie rods 78, 80 are shown to include respective turnbuckles 92, 94 that can be rotated to change the length of the upper and lower tie rods 78, 80. When a user wants to change the position of adjacent right spray heads 58 relative to each other, the appropriate turnbuckle(s) 92, 94 can be rotated to adjust the length of the upper and lower tie rod(s) 78, 80 accordingly. For example, when the right spray heads 58 associated with the upper and central trigger plates 70, 72 are to be moved relative to each other, the turnbuckle 92 can be rotated to change the length of the upper tie rod 78 to allow for such movement. Similarly, when the right spray heads 58 associated with the central and lower trigger plates 72, 74 are to be moved relative to each other, the turnbuckle 94 can be rotated to change the length of the lower tie rod 80 to allow for such movement. It is to be appreciated that the tie rods and/or the turnbuckles can be any of a variety of lengths to allow for certain travel distances between adjacent spray heads. For example, longer turnbuckles can be provided on the upper and lower tie rods 78, 80 to allow for greater distance variation between the right spray heads 58.

Each of the right spray heads 58 can include a rear rotatable knob 96 that can be rotated to vary the angle of the right spray heads 58 with respect to the right support post 88. Releasing the rear rotatable knobs 96 can also allow the right spray heads 58 and corresponding trigger plates 70, 72, 74 to rotate about the right support post 88. The right spray heads 58 can accordingly be moved in any XYZ direction to conform to any of a variety of applications. The right support post 88 can be selectively held in place with a main rotatable knob 98.

Referring again to FIGS. 1-3, a feeler arm 99 can be provided on the right support post 88 that defines an appropriate distance for the right spray heads 58 relative to the paint surface. As the wheeled cart 12 moves along the paint surface, the user can monitor the feeler arm 99 and can steer the wheeled cart 12 to ensure that the feeler arm 99 remains close to the paint surface without touching it. This can provide a consistent application of paint and can reduce striping/over-application in particular areas.

It is to be appreciated that the left spray heads 60 can be similar to the right spray heads 58, but instead mounted on a left side of the wheeled cart 12. Triggering mechanisms 69 (FIG. 2) can be associated with the left spray heads 60 and can be similar to, or the same as, in many respects as the triggering mechanisms 68. However, the triggering mechanisms 69 can be selectively actuated by a right lever 84 mounted on the handlebars 14. It is to be appreciated that in some embodiments, each of the triggering mechanisms 68, 69 can be actuated together by a single lever or other suitable device.

It is to be appreciated that the right and left spray heads 58, 60 can be arranged to paint any of a variety of surfaces including but not limited to overhead surfaces. It is also to be appreciated that although the right and left spray heads 58, 60 are described as dispensing paint, that any of a variety of suitable alternative fluids can be dispensed from the carriage 32, such as other coatings, solvents, water, or the like.

The system 10 can be used to paint a variety of structures, such as an exterior surface of a building (not shown). To begin painting the structure, the distance between each of the right spray heads 58 and left spray heads 60 can be selected. The wheeled cart 12 can then be provided substantially parallel to the structure with one set of the spray heads (e.g., the right spray heads 58) proximate the structure. The user can then actuate the right lever 84 to dispense paint from the right spray heads 58 and can walk the wheeled cart 12 along the structure to apply a first coat of paint to the structure. Once the first horizontal coat has been successfully applied (i.e., the entire length of the paint surface has been traversed), the wheeled cart 12 can be turned around such that the other set of the spray heads (e.g., the left spray heads 60) is now proximate the structure. The user can then actuate the left lever 100 to dispense paint from the left spray heads 60 and can walk the wheeled cart 12 along the structure to apply a second horizontal coat of paint to the structure. Once the second horizontal coat has been successfully applied, the wheeled cart 12 can be turned around such that the original set of the spray heads (e.g., the right spray heads 58) is again proximate the structure. The carriage 32 can then be raised until the original spray heads are positioned adjacent to the unpainted surface above the newly applied paint. The user can then apply first and second coats of paint to the unpainted surface in the manner described above. The user can then raise the carriage 32 to reach a more elevated surface of the structure and can repeat the process until the entire surface has been painted.

In one embodiment, the carriage 32 can be provided with a back roller (not shown) that rolls the painted surface after spraying to facilitate more even distribution of paint. It is to be appreciated that, in one embodiment, as shown in FIGS. 1-3, the positions of the right spray heads 58 can be staggered with respect to the positions of the left spray heads 60 to provide a more consistent application of paint. For example, if the right spray heads 58 are positioned at 0 inches, 12 inches, and 24 inches (measured from bottom of the right support post 88), the left spray heads 60 can be positioned at 6 inches, 18 inches, and 30 inches.

It is to be appreciated that the system 10 can incorporate many of the features and solve many of the challenges described in U.S. Pat. No. 8,726,833, which is hereby incorporated by reference herein in its entirety.

Figure 5:
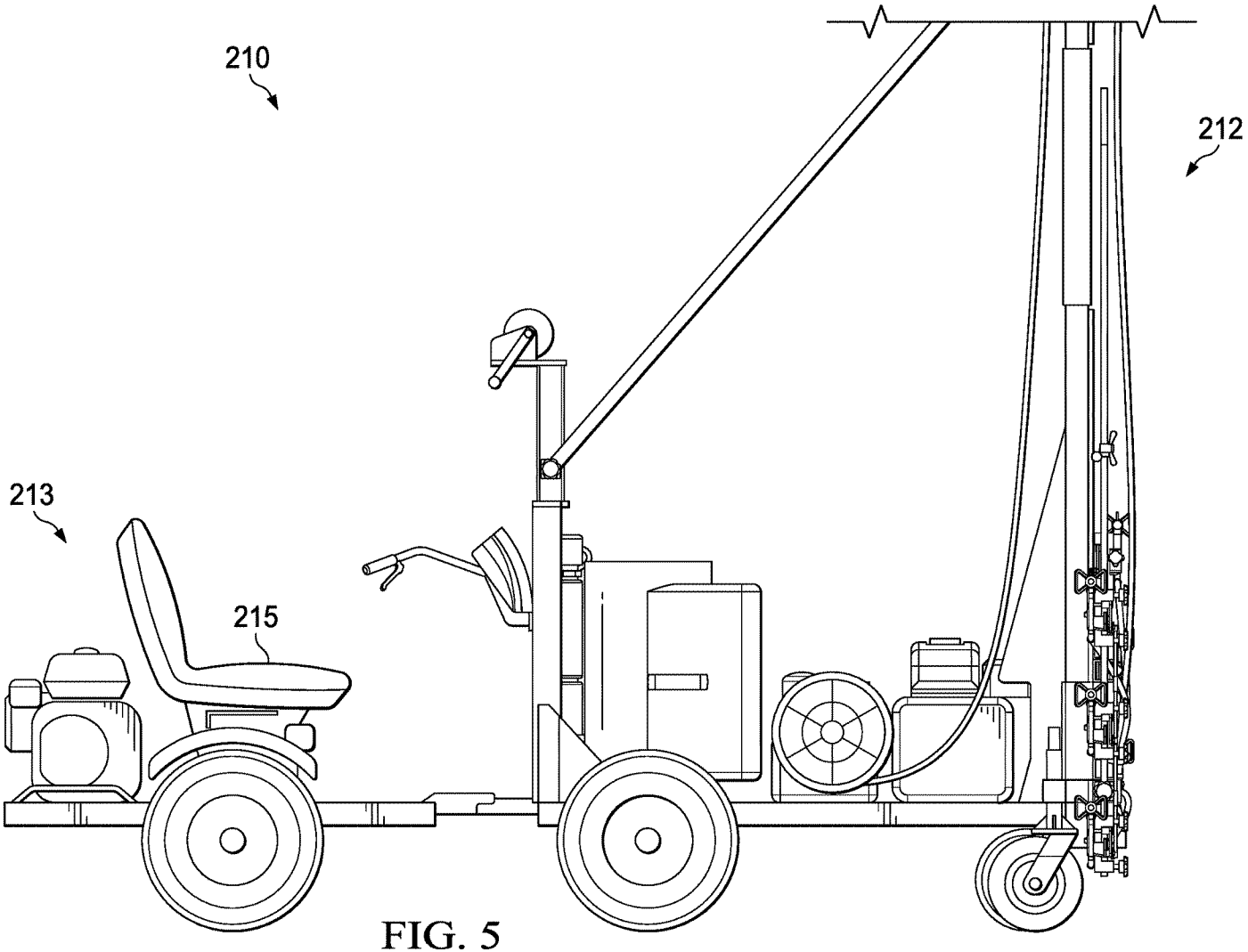
FIG. 5 is a side view depicting a system for painting a structure according to another embodiment.

FIG. 5 illustrates a system 210 according to another embodiment. The system 210 can have a wheeled cart 212 that is similar to, or the same as, in many respects as wheeled cart 12. However, the wheeled cart 212 can be coupled with a passenger operated motorized cart 213 having a seat 215 that supports an operator. The passenger operated motorized cart 213 can propel the wheeled cart 212 and can allow for steering of the wheeled cart 212 from the passenger operated motorized cart 213. The passenger operated motorized cart 213 can be a golf cart, a tractor, a truck, a sport utility vehicle (SUV), an all-terrain vehicle (ATV), a utility vehicle (UTV), or any of a variety of suitable alternative fuel-powered or electric-powered vehicles.

Figure 6:
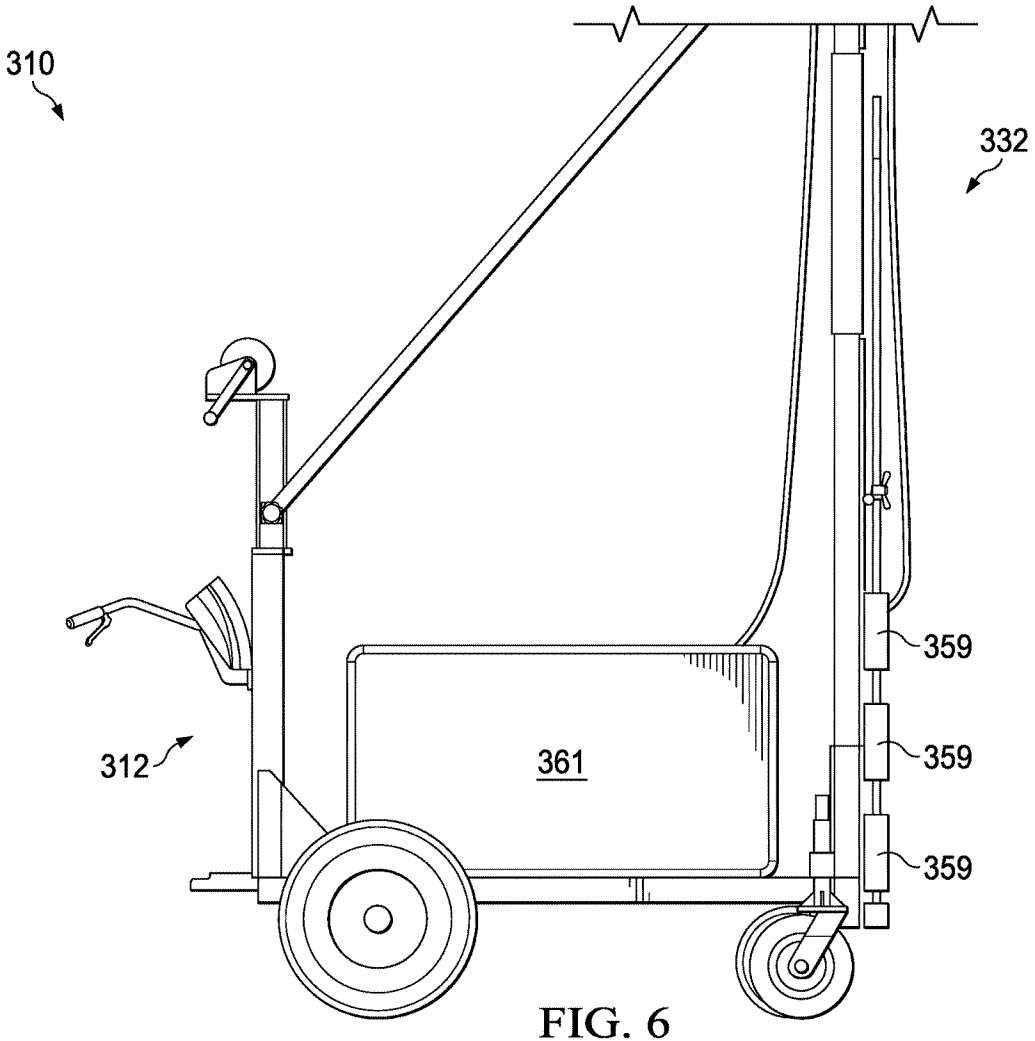
FIG. 6 is a side view depicting a system for painting a structure according to yet another embodiment.

FIG. 6 illustrates a system 310 that is similar to, or the same as, in many respects as the systems 10, 210 of FIGS. 1-4 and 5, respectively. For example, the system 310 can include a wheeled cart 312 and a carriage 332. However, the system 310 can include a plurality of surface treatment devices 359 and a supply unit 361 associated with the surface treatment devices 359. The surface treatment devices 359 can be any of a variety of devices that facilitate other treating methods for a surface, such as, for example, a power washer, scrubber, sand blaster, or the like. The supply unit 361 can be any device that facilitates a supply of appropriate material(s) to the surface treatment devices 359 that facilitate the other treating methods. For example, the supply unit 361 can be configured to provide water for power washing or scrubbing or to provide sand for sand blasting.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A system for treating a surface, the system comprising:
- a wheeled cart comprising:
  - a frame; and
  - a plurality of wheels rotatably coupled with the frame;
- a lift structure coupled with the frame, the lift structure comprising:
  - a mast;
  - a carriage slidably coupled with the mast and movable between a raised position and a lowered position;
  - a plurality of first spray heads coupled with the carriage and disposed on a right side of the wheeled cart; and
  - a plurality of second spray heads coupled with the carriage and disposed on a left side of the wheeled cart; and
- a pump in fluid communication with the plurality of first spray heads and the plurality of second spray heads and configured to distribute a fluid to the plurality of first spray heads and the plurality of second spray heads.

2. The system of claim 1 wherein:
- the carriage further comprises a first support post and a second support post;
- each of the first spray heads are slidably coupled with the first support post; and
- each of the second spray heads are slidably coupled with the second support post.

3. The system of claim 2 wherein:

each of the first spray heads is slidable along the first support post relative to the other first spray heads; and each of the second spray heads is slidable along the second support post relative to the other second spray heads.

4. The system of claim 3 further comprising:

a plurality of first rotatable knobs that are each associated with one of the first spray heads and each configured to facilitate selective securement of one of the first spray heads to the first support post; and a plurality of second rotatable knobs that are each associated with one of the second spray heads and each configured to facilitate selective securement of one of the second spray heads to the second support post.

5. The system of claim 1 further comprising:

a plurality of first triggering mechanisms that are each associated with one of the first spray heads and configured to facilitate dispensation of paint therefrom; and a plurality of second triggering mechanisms that are each associated with one of the second spray heads and configured to facilitate dispensation of paint therefrom.

6. The system of claim 5 wherein:

each of the first triggering mechanisms are operably coupled together to facilitate substantially simultaneous dispensation of paint from the first spray heads; and each of the second triggering mechanisms are operably coupled together to facilitate substantially simultaneous dispensation of paint from the second spray heads.

7. The system of claim 6 further comprising:

at least one first tie rod, each at least one first tie rod being coupled with different ones of the first triggering mechanisms; and at least one second tie rod, each at least one second tie rod being coupled with different ones of the second triggering mechanisms.

8. The system of claim 7 wherein:

each at least one first tie rod comprises a turnbuckle that is rotatable to change the length of the at least one first tie rod; and each at least one second tie rod comprises a turnbuckle that is rotatable to change the length of the at least one second tie rod.

9. The system of claim 8 further comprising:

a first cable configured to facilitate selective actuation of the plurality of first triggering mechanisms; and a second cable configured to facilitate selective actuation of the plurality of second triggering mechanisms.

10. A system for treating a surface, the system comprising:

a wheeled cart comprising:

a frame; and a plurality of wheels rotatably coupled with the frame;

a lift structure coupled with the frame, the lift structure comprising:

a mast;

a carriage comprising a support post, the carriage being slidably coupled with the mast and movable between a raised position and a lowered position; and a surface treatment device comprising a spray head disposed on one or more of a right side and a left side of the wheeled cart, the spray head being movably coupled with the support post and slidable along the support post a supply unit in communication with the spray head and configured to supply paint to the spray head;

a triggering mechanism operably coupled with the spray head and configured to facilitate dispensation of paint therefrom; and a cable coupled with the triggering mechanism and configured to facilitate selective actuation of the triggering mechanism.

11. The system of claim 10 wherein the wheeled cart further comprises a seat for supporting an operator.

12. The system of claim 10 further comprising a feeler arm that defines an appropriate distance for the spray head relative to the surface.

13. A system for treating a surface, the system comprising:

a carriage;

a plurality of spray heads coupled with the carriage;

a pump in fluid communication with the plurality of spray heads and configured to distribute a fluid to the plurality of spray heads; and a plurality of triggering mechanisms that are each associated with one of the spray heads and configured to facilitate dispensation of fluid therefrom, wherein the triggering mechanisms are operably coupled together to facilitate substantially simultaneous dispensation of paint from the spray heads.

14. The system of claim 13 further comprising at least one tie rod, each at least one tie rod being coupled with different triggering mechanisms and configured to facilitate substantially simultaneous actuation of the triggering mechanisms.

* * * * *